US007278801B2

(12) United States Patent
Chianis et al.

(10) Patent No.: US 7,278,801 B2
(45) Date of Patent: Oct. 9, 2007

(54) METHOD FOR DEPLOYING FLOATING PLATFORM

(75) Inventors: John Chianis, Katy, TX (US); Jayant Basak, Houston, TX (US); Chandramohan Nair, Houston, TX (US); Stephen Bultema, Houston, TX (US); Jeremy Denman, Spring, TX (US)

(73) Assignee: Deepwater Marine Technology L.L.C., George Town, Grand Cayman ( * ) Notice: Subject to any disclaimer, the term of this patent is extended or adjusted under 35 U.S.C. 154(b) by 59 days.

(21) Appl. No.: 11/140,666

(22) Filed: May 27, 2005
(Under 37 CFR 1.47)

(65) Prior Publication Data

US 2005/0281623 A1 Dec. 22, 2005

Related U.S. Application Data

(60) Provisional application No. 60/575,632, filed on May 28, 2004.

(51) Int. Cl.
*B63B 21/00* (2006.01)

(52) U.S. Cl. ..... 405/223.1; 405/224

(58) Field of Classification Search ..... 405/205, 405/223.1, 224, 224.1–224.4; 114/264
See application file for complete search history.

(56) References Cited

U.S. PATENT DOCUMENTS 5,330,293 A * 7/1994 White et al. ..... 405/224
5,791,819 A * 8/1998 Christiansen ..... 405/224
6,022,174 A * 2/2000 Husvik et al. ..... 405/223.1
6,139,224 A * 10/2000 Michel et al. ..... 405/224
6,190,089 B1 * 2/2001 Bennett et al. ..... 405/200
6,230,645 B1 * 5/2001 Chow ..... 114/264
6,273,018 B1 * 8/2001 Gottsche et al. ..... 114/264
6,371,697 B2 4/2002 Huang et al.
6,503,023 B2 1/2003 Huang et al.
6,666,624 B2 * 12/2003 Wetch ..... 405/205
6,786,679 B2 9/2004 Huang et al.
6,869,251 B2 3/2005 Zou et al.
6,932,542 B2 * 8/2005 Chianis et al. ..... 405/223.1
2004/0190999 A1 9/2004 Wybro et al.

OTHER PUBLICATIONS

Tension Leg Platform (TLP), http://www.globalsecurity.org/military/systems/ship/platform-tension-leg.htm, 3 page website printout dated Apr. 25, 2007.

* cited by examiner

*Primary Examiner*—Frederick L. Lagman
(74) *Attorney, Agent, or Firm*—Bracewell & Giuliani LLP

(57) ABSTRACT

A method for deploying a floating platform at an offshore wellsite uses pull-down lines to provide stability to the platform while ballasting. The platform is equipped with a number of tension devices and towed to a staging site while at a first draft, At the staging site, the operator connects lines from the sea floor to the tension devices on the platform. The operator gradually adds ballast to the platform and simultaneously applies tension to the lines with the tension devices. When at a desired second draft, the operator detaches the lines and tows the platform to a well site. The platform is moored with a catenary mooring system at the well site.

18 Claims, 2 Drawing Sheets

METHOD FOR DEPLOYING FLOATING PLATFORM

This invention claims the benefit of provisional application Ser. No. 60/575,632, filed May 28, 2004.

FIELD OF THE INVENTION

This invention relates in general to methods for ballasting floating platforms at offshore well sites, and in particular to a method for deploying pre-installed lines for pulling the floating vessel down to a desired ballast level.

BACKGROUND OF THE INVENTION

Offshore floating platforms are utilized for hydrocarbon extraction and processing. The platforms have tanks that provide the necessary floatation. Water is pumped into at least some of the tanks to provide ballast for positioning the platform at a desired draft. A certain amount of draft may be necessary to prevent capsizing under the effects of wind and waves during storms. The desired draft might be needed both for towing to a wellsite as well as while stationed at the wellsite.

Typically, when a platform is being ballasted to the desired draft, it will undergo a region of instability between the initial draft and the desired draft. While in the region of instability, the righting moment of the platform is insufficient to keep the platform upright if it heels excessively. The ballasting must be carefully controlled while in the region of instability to avoid a catastrophe.

Some platforms have a very deep draft, which may be hundreds of feet. Typically, these platforms having a single cylindrical column and may be called "spars" or "deep draft caisson vessels". Typically, they are towed to the well site while in a horizontal position, then ballasted to an upright position. These vessels also undergo a region of instability, thus upending the structure at the well site has associated risks. After being upended and ballasted to the desired depth, a catenary mooring system is used to hold the vessel at the well site. A large barge and crane at the well site lifts a deck structure onto the spar after its is at the desired draft and moored.

U.S. Pat. No. 6,371,697 discloses a single column floater that has a larger diameter lower section to provide stability and buoyancy. This patent discloses towing the single column floater to the well site in an upright position. The vessel is towed to the well site at a towing draft, then ballasted at the well site to a desired draft. A catenary mooring system holds the single column floater on station. The deck and structure may be placed on the single column floater while at the dockside, avoiding a need for a barge and crane at the well site. Even though ballasting occurs while the vessel is upright, instability can still exist during the process.

One proposed method to provide stability during ballasting deals specifically with tension leg platforms ("TLP"). A TLP is not moored with a catenary mooring system, rather it is held on station by tendons under tension. The tendons comprise hollow, buoyant strings of pipe extending vertically upward from the sea floor to the platform. Normally the TLP is towed to the well site at a first draft, then ballasted to a second draft. The operator connects the tendons to the TLP and removes ballast to place the tendons in tension. U.S. Patent Application Publication 2004/0190999 discloses connecting pull-down lines between upper ends of the tendons and pull down devices on the platform. The operator applies tension to the pull-down lines while ballasting to avoid instability. When the tops of the tendons pass through the top terminations on the platform, the operator connects the tendons to the platform, removes the pull-down lines, and deballasts until the desired tension in the tendons is reached.

SUMMARY OF THE INVENTION

In this invention, the floating platform is equipped with a plurality of tension devices. Temporary pull-down lines are connected from the sea floor to the tension devices on the platform. The operator adds ballast to the platform and simultaneously applies tension to the pull-down lines with the tension devices until the platform reaches a desired draft. The operator then detaching the pull-down lines from the tension devices and moors the platform with a catenary mooring system.

In a preferred method, the temporary pull-down lines are located at a staging site. The operator tows the platform from a dockside to a staging site while at a first draft. The operator ballasts the platform at the staging site to a second draft, then tows the platform to the well site while at the second draft. The operator installs the catenary mooring system while at the well site.

The platform may be of a type having a single column. In a preferred method, the platform is a single column floater, and it is towed in an upright orientation.

DETAILED DESCRIPTION OF THE INVENTION

Figure 1:
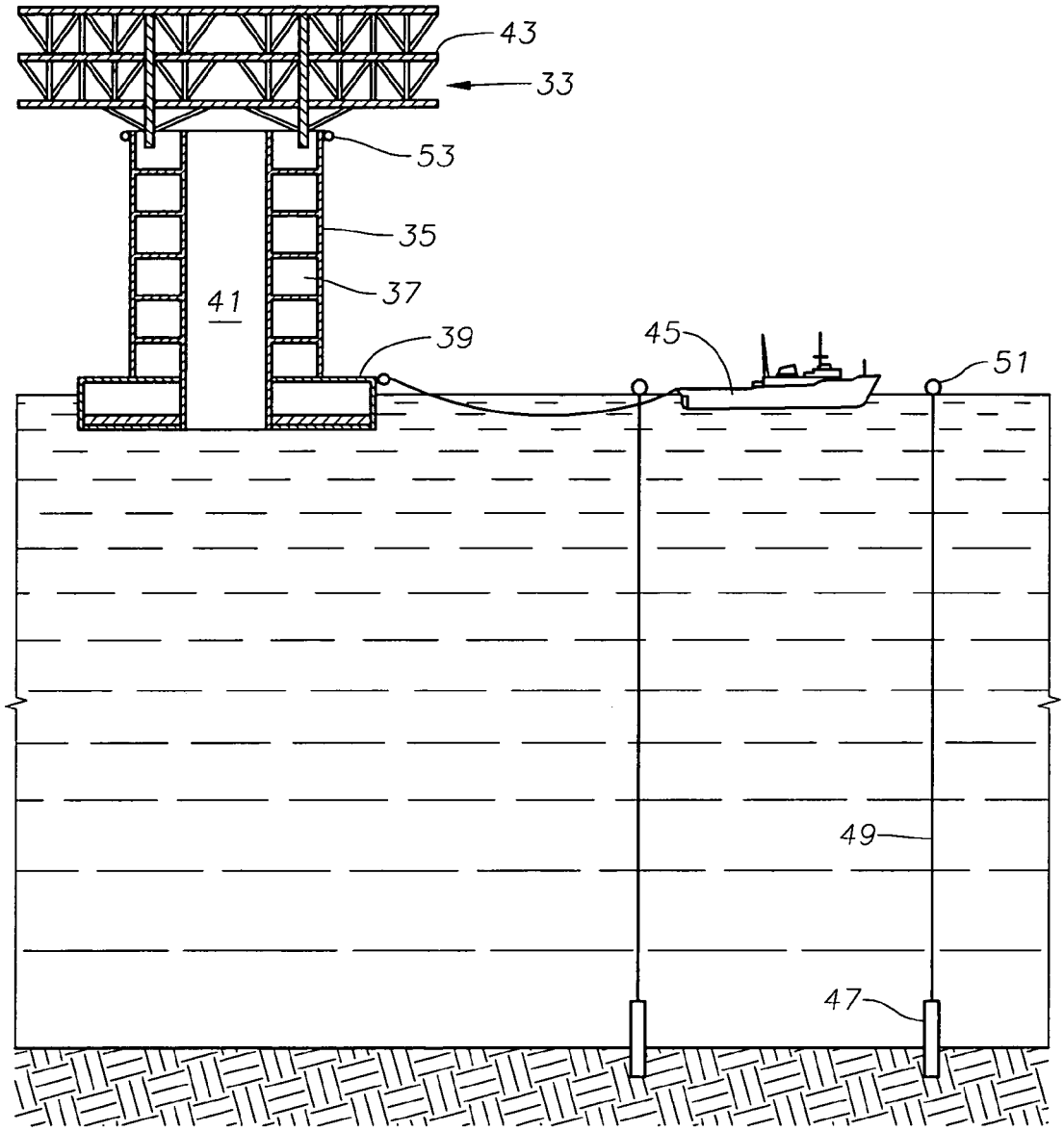
FIG. 1 is a schematic view of a single column platform at a temporary staging site in the process of being lowered to a desired towing draft.

Referring to FIG. 1, platform 33 has a single elongated column 35, which is a single column floater type as shown in U.S. Pat. No. 6,371,697, or it may be of other types. In the preferred embodiment, column 35 has a plurality of separate compartments 37 and a cylindrical base 39. Base 39 has a larger diameter than column 35. A central passage 41 extends through column 35. If platform 33 is to be used as a drilling platform or as a production platform through which risers will extend, central passage 41 will be open at the bottom. Platform 33 has decks 43 for supporting well drilling and/or production equipment.

Figure 3:
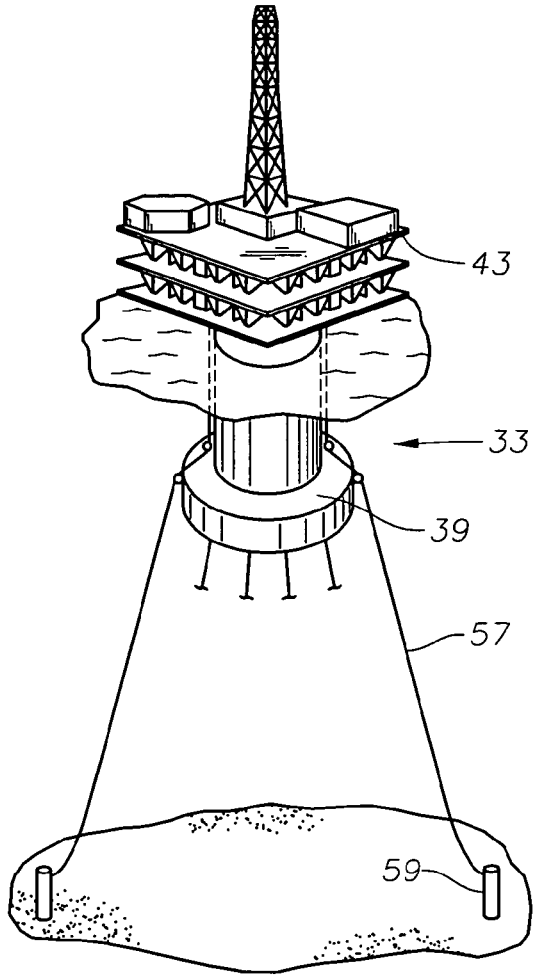
FIG. 3 is a perspective view illustrating the single column platform of FIG. 2 moored to a well site for well drilling operations.

The contractor optionally installs decks 43 at dockside during construction of platform 33. Platform 33 is of a design that allows it to be towed while in a vertical orientation to the well site. However, while being towed to a well site, platform 33 should be at a safe towing draft. In FIG. 3, tug 45 is shown towing platform 33 at a dockside draft, which is not considered safe for long distance towing. The water depth at the dockside typically is not adequate to ballast platform 33 to a desired towing level.

In order to place platform 33 in a desired ballast draft for towing, a pull-donor staging site is constructed where the water is deep enough to ballast platform 33 to the towing draft. The staging site, for example, may be in 200 to 500 feet of water. As shown in FIG. 3, the staging site has piles 47 on the sea floor. Pull-down lines 49 extend upward from piles 47 on the sea floor. Initially, buoys 51 are attached to upper ends of lines 49 to support the upper ends near the surface of the sea. Buoys 51 will support lines 49 in generally vertical orientations. Piles 47 are placed apart from each other to define a perimeter that is substantially the same as the perimeter of platform 33, which is cylindrical in the preferred embodiment. Lines 49 will be installed normally before platform 11 reaches the site. Pull-down lines 49 are flexible and may be chain, cable, rope or other types of line, but would not be tubular pipes, such as tendons. It is not necessary for lines 49 to be buoyant.

Figure 2:
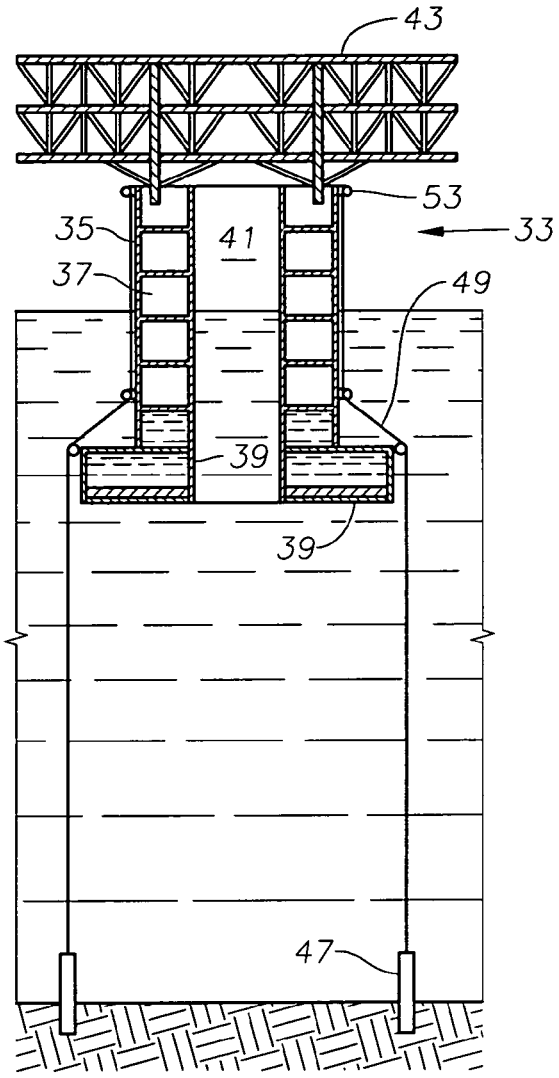
FIG. 2 is a schematic view of the single column platform of FIG. 3, shown at the desired towing draft at the temporary staging site.

Tensioning devices 53 are mounted to platform 33. Each tension device 53 may be a winch, chain jack, strain jack, rotating block, or other means for applying and maintaining tension in one of the pull-down lines 49. Pull-down lines 49 are secured to tension devices 53 after platform 33 is positioned over piles 47, as shown in FIG. 2. The operator then applies tension to pull-down lines 49, pulling platform 33 downward to a desired ballast level. While pulling platform 33 downward, sea water is allowed to flow into compartments 37 in a controlled manner for ballasting. The amount of seawater is controlled to always maintain a desired amount of tension in pull-down lines 49 until reaching the desired depth. Tension in pull-down lines 49 keeps a righting moment on platform 33 as it moves downward through a region of instability. Once at the desired towing draft, which is past the region of instability, the ballast will be increased an amount necessary to maintain platform 33 at that depth after freed from pull-down lines 49. Platform 33 is illustrated in FIG. 2 at a safe towing draft, but still connected to pull-down lines 49.

The operator then disconnects platform 33 from pull-down lines 49 and tows platform 33 to the desired well site. If desired, the operator may remove pull-down lines 49 from the sea floor. Once at the desired installation site, the operator moors platform 33 in a conventional manner using catenary mooring lines 57, each attached to an anchor or pile 59. The catenary mooring system may be conventional, with each mooring line 57 comprising an anchor rode that attaches to a pile 59 located beyond the perimeter of platform 33. Each line 57 extends from platform 33 to a pile 59 in a long, gradual curve. The perimeter defined by piles 59 is much greater in diameter than the perimeter of platform 33. The operator may wish to add ballast to platform 33 while at the well site. Tension lines or tendons are not required.

The invention has significant advantages. The pull-down lines allow one to ballast a platform through a region of instability with less risk than in the prior art. The method does not require tendons, rather may be used with catenary moored systems. The staging site allows one to ballast a platform to a safe towing draft before towing the platform to a remote well site.

While the invention has been shown in only one of its forms, it should be apparent to those skilled in the art that it is not so limited but is susceptible to various changes without departing from the scope of the invention.

The invention claimed is:

1. A method for deploying a floating platform at an offshore wellsite, comprising:

(a) equipping the platform with a plurality of tension devices;

(b) connecting flexible pull-down lines from the sea floor to the tension devices on the platform; then (c) adding ballast to the platform and applying tension to the flexible pull-down lines with the tension devices to move the platform downward to a selected draft; then (d) detaching the flexible pull-down lines from the tension devices and mooring the platform with a catenary mooring system.

2. The method according to claim 1, wherein in step (c) the rate at which ballast is added is controlled to assure that tension is continuously applied to the flexible pull-down lines at least until a zone of instability has been exceeded.

3. The method according to claim 1, wherein the catenary mooring system comprises a plurality of anchor rodes, each rode having a lower end secured to the sea floor at a point beyond the perimeter of the platform.

4. The method according to claim 1, wherein the flexible pull-down lines are attached to pilings located substantially below the platform.

5. The method according to claim 1, further comprising after step (c) and before step (d), towing the platform while at the selected draft to a well site remote from the flexible pull-down lines.

6. The method according to claim 1, wherein the platform comprises a single column floater, and wherein the method further comprises:

before step (b), towing the platform from a dockside area while at an initial draft and in an upright configuration to the vicinity of the flexible pull-down lines.

7. The method according to claim 1, further comprising:

before step (b), towing the platform from a dockside area while at an initial draft and in an upright configuration to the vicinity of the flexible pull-down lines; and after step (c) and before step (d), towing the platform while at the selected draft to a well site remote from the flexible pull-down lines.

8. A method for deploying a floating platform at an offshore wellsite, comprising:

(a) equipping the platform with a plurality of tension devices;

(b) towing the platform to a staging site while at a first draft;

(c) at the staging site, connecting lines from the sea floor to the tension devices on the platform; then (d) adding ballast to the platform and applying tension to the lines with the tension devices to move the platform downward to a second draft; then (e) detaching the lines and towing the platform while at the second draft from the staging site to a well site; then (f) mooring the platform at the well site.

9. The method according to claim 8, wherein the platform has a single column, and wherein step (b) comprises towing the platform to the staging site while the platform is in an upright orientation.

10. The method according to claim 8, wherein the platform has a single column, and wherein step (e) comprises towing the platform to the well site while the platform is in an upright orientation.

11. The method according to claim 8, wherein the platform has a single column, and wherein steps (b) and (e) comprise towing the platform while the platform is in an upright position.

12. The method according to claim 8, wherein step (a) comprises mounting the tension devices above sea level.

13. The method according to claim 8, wherein step (c) comprises securing lower ends of the lines to pilings on the sea floor.

14. The method according to claim 8, wherein step (c) comprises prior to towing the platform to the staging site, securing lower ends of the lines to pilings on the sea floor and supporting upper portions of the lines with buoyant devices.

15. The method according to claim 8, further comprising after step (f) attaching a deck to the platform.

16. The method according to claim 8, wherein step (f) comprises using a catenary mooring system.

17. A method for deploying a single column floating platform at an offshore wellsite, comprising:

(a) at a staging site, connecting lower ends of a plurality of lines to pilings in the sea floor and attaching buoyant devices to upper portions of the lines;

(b) equipping the platform with a plurality of tension devices;

(c) towing the platform from a dockside area to the staging site while at a first draft and while the column is in a vertical orientation;

(d) at the staging site, connecting the upper portions of the lines to the tension devices on the platform; then (e) adding ballast to the platform and applying tension to the lines with the tension devices to move the platform downward to a second draft; then (f) detaching the lines and towing the platform while at the second draft from the staging site to a well site; then (g) mooring the platform at the well site with a catenary mooring system.

18. The method according to claim 17, wherein the lines comprise wire rope.

* * * * *